US011847979B2

(12) United States Patent
Jeong

(10) Patent No.: US 11,847,979 B2
(45) Date of Patent: Dec. 19, 2023

(54) DISPLAY APPARATUS AND DRIVING METHOD THEREOF

(71) Applicant: LX SEMICON CO., LTD., Daejeon (KR)

(72) Inventor: Byeong Ho Jeong, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 18/073,099

(22) Filed: Dec. 1, 2022

(65) Prior Publication Data

US 2023/0215390 A1 Jul. 6, 2023

(30) Foreign Application Priority Data

Dec. 31, 2021 (KR) ..... 10-2021-0193937

(51) Int. Cl.
*G09G 3/3291* (2016.01)
*G09G 3/20* (2006.01)

(52) U.S. Cl.
CPC ..... *G09G 3/3291* (2013.01); *G09G 3/2096* (2013.01); *G09G 2300/0828* (2013.01); *G09G 2310/0289* (2013.01); *G09G 2310/0291* (2013.01); *G09G 2320/0673* (2013.01)

(58) Field of Classification Search
CPC ..... G09G 3/3291; G09G 3/2096; G09G 2300/0828; G09G 2310/0289; G09G 2310/0291; G09G 2320/0673; G09G 3/20; G09G 3/3688
See application file for complete search history.

(56) References Cited

U.S. PATENT DOCUMENTS

| | | | | |
|---|---|---|---|---|
| 2012/0194745 | A1 | 8/2012 | Chang et al. | |
| 2019/0304395 | A1* | 10/2019 | Kim | G09G 3/3291 |
| 2022/0013070 | A1* | 1/2022 | Ma | G09G 3/3233 |
| 2022/0044640 | A1* | 2/2022 | Lee | G09G 3/3275 |

* cited by examiner

*Primary Examiner* — Premal R Patel
(74) *Attorney, Agent, or Firm* — Greenberg Traurig, LLP

(57) ABSTRACT

Disclosed is a display apparatus which may prevent a settling time from being changed when image data input to a source drive integrated circuit (IC) is changed, for voltage interpolation. The display apparatus includes a source drive integrated circuit (IC) configured to sequentially perform a first voltage interpolation and a second voltage interpolation at every horizontal period so as to drive a data line by using N bit image data including an M bit interpolation code and an N−M bit image code.

20 Claims, 7 Drawing Sheets

FIG. 5

| LB2 | VINT1 | VINT2 | VINT3 | VINT4 | VINT5 | VINT6 | VINT7 | VINT8 | VO1 |
|---|---|---|---|---|---|---|---|---|---|
| 0(=000) | VINP_L | VINP_L | VINP_L | VINP_L | VINP_L | VINP_L | VINP_L | VINP_L | VINP_L |
| 1(=001) | VINP_H | VINP_L | VINP_L | VINP_L | VINP_L | VINP_L | VINP_L | VINP_L | 1*VINP_H/8 + 7*VINP_L/8 |
| 2(=010) | VINP_H | VINP_H | VINP_L | VINP_L | VINP_L | VINP_L | VINP_L | VINP_L | 2*VINP_H/8 + 6*VINP_L/8 |
| 3(=011) | VINP_H | VINP_H | VINP_H | VINP_L | VINP_L | VINP_L | VINP_L | VINP_L | 3*VINP_H/8 + 5*VINP_L/8 |
| 4(=100) | VINP_H | VINP_H | VINP_H | VINP_H | VINP_L | VINP_L | VINP_L | VINP_L | 4*VINP_H/8 + 4*VINP_L/8 |
| 5(=101) | VINP_H | VINP_H | VINP_H | VINP_H | VINP_H | VINP_L | VINP_L | VINP_L | 5*VINP_H/8 + 3*VINP_L/8 |
| 6(=110) | VINP_H | VINP_H | VINP_H | VINP_H | VINP_H | VINP_H | VINP_L | VINP_L | 6*VINP_H/8 + 2*VINP_L/8 |
| 7(=111) | VINP_H | VINP_H | VINP_H | VINP_H | VINP_H | VINP_H | VINP_H | VINP_L | 7*VINP_H/8 + 1*VINP_L/8 |

DISPLAY APPARATUS AND DRIVING METHOD THEREOF

CROSS-REFERENCE TO RELATED APPLICATIONS

This application claims the benefit of the Korean Patent Application No. 10-2021-0193937 filed on Dec. 31, 2021, which is hereby incorporated by reference as if fully set forth herein.

FIELD OF THE INVENTION

The present disclosure relates to a display apparatus, and more particularly, to a source drive integrated circuit (IC) of a display apparatus.

BACKGROUND

With the advancement of information-oriented society, various requirements for display apparatuses for displaying an image are increasing. Based on such requirements, various types of display apparatuses such as not only liquid crystal display (LCD) apparatuses of the related art but also organic light emitting display (OLED) apparatuses are being practically used.

Such display apparatuses include a plurality of source drive ICs for supplying data voltages to data lines of a display panel, a plurality of gate drive ICs for sequentially supplying a gate pulse (or a scan pulse) to gate lines (or scan lines) of the display panel, and a timing controller for controlling the source drive ICs and the gate drive ICs.

Recently, as source drive ICs have a voltage interpolation function, technology for reducing a size of source drive ICs is being developed. However, in source drive ICs having the voltage interpolation function, when image data input to a source drive IC is changed for the voltage interpolation, a settling time is changed, and due to this, there is a problem where a screen change recognizable by a user may occur in display apparatuses driven by source drive ICs.

SUMMARY

Accordingly, the present disclosure is directed to providing a display apparatus and a driving method thereof that substantially obviate one or more problems due to limitations and disadvantages of the related art.

An aspect of the present disclosure is directed to providing a display apparatus and a driving method thereof, which may prevent a settling time from being changed when image data input to a source drive IC is changed for voltage interpolation.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display apparatus including a source drive integrated circuit (IC) configured to sequentially perform a first voltage interpolation and a second voltage interpolation at every horizontal period so as to drive a data line by using N bit image data including an M bit interpolation code and an N−M bit image code, wherein the source drive IC performs the first voltage interpolation by using an M bit reference code set in common for each channel and performs the second voltage interpolation by using the M bit interpolation code.

In another aspect of the present disclosure, there is provided a driving method of a display apparatus, the driving method including: sequentially storing N bit image data of each channel in a first latch circuit by bit units, the N bit image data including an N−M bit image code and an M bit interpolation code; simultaneously storing the N−M bit image code stored in the first latch circuit and an M bit reference code in a second latch circuit. M bit reference code being set in common for each channel; performing a first voltage interpolation by using the M bit reference code; updating the M bit reference code stored in the second latch circuit to the M bit interpolation code stored in the first latch circuit; and performing a second voltage interpolation by using the M bit interpolation code.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings:

FIG. 5 is a table showing an output signal and input signals of the amplifier circuit illustrated in FIG. 4;

DETAILED DESCRIPTION OF THE DISCLOSURE

Figure 1:
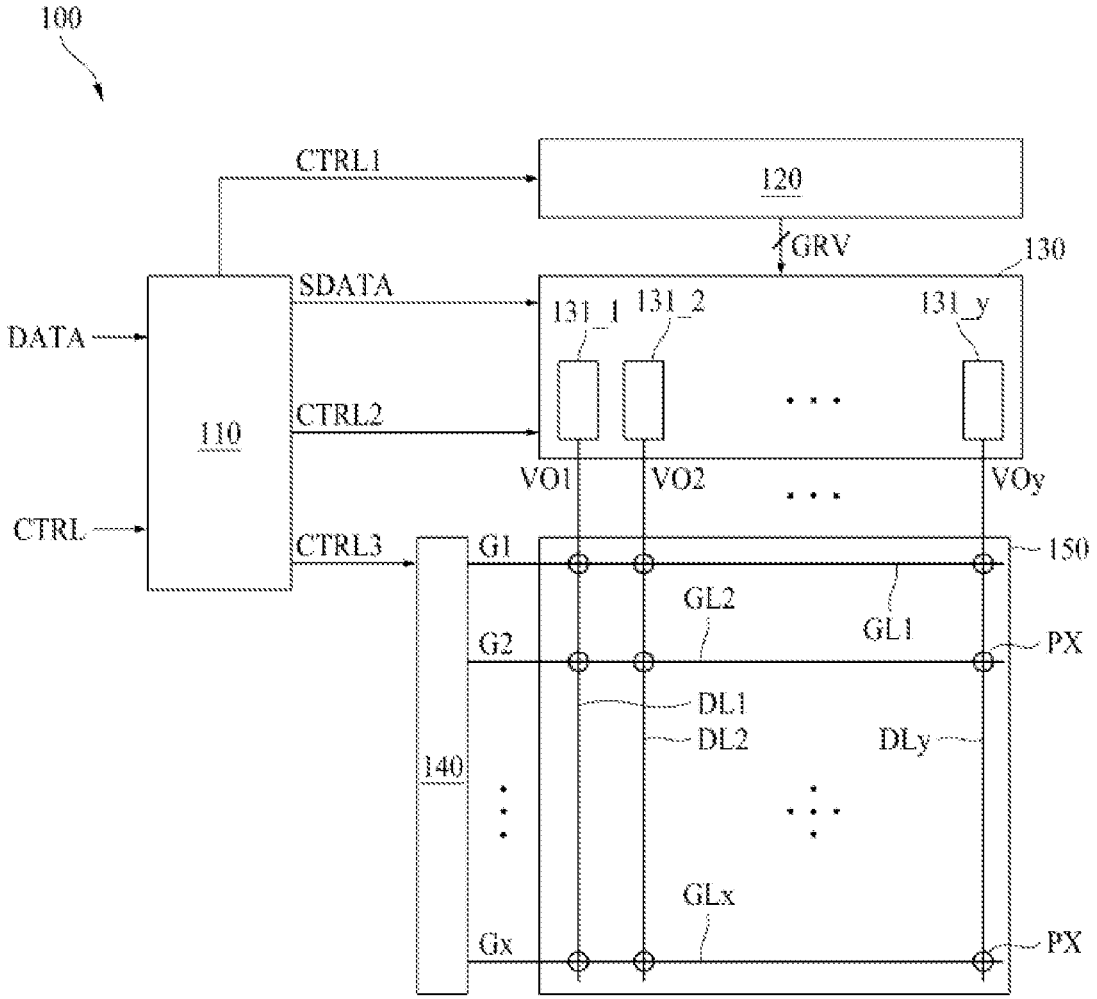
FIG. 1 is a block diagram of a display apparatus according to an embodiment of the present invention.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

FIG. 1 is a block diagram of a display apparatus according to an embodiment of the present invention. Referring to FIG. 1, the display apparatus 100 may include a timing controller 110, a gamma reference voltage generator 120, a source driving circuit 130, a gate driving circuit 140, and a display panel 150. In FIG. 1, The timing controller 110, the gamma reference voltage generator 120, the source driving circuit 130, and the gate driving circuit 140 may configure a display driving apparatus.

The display apparatus 100 may be a television (TV), a monitor, or a mobile device. The mobile device may be a laptop computer, a smartphone, a mobile Internet device (MID), or a wearable computer.

The timing controller 110 may receive a raw input signal DATA and control signals CTRL. The timing controller 110 may generate N bit image data SDATA by using the raw input signal DATA and may generate a first control signal CTRL1 (for example, a gamma reference voltage control signal), a second control signal CTRL2 (for example, a source control signal), and a third control signal CTRL3 (for example, a gate control signal) by using the control signals CTRL. The raw input signal DATA may be an analog image signal or an analog video signal, or may be an RGB image signal. For example, the N bit image data SDATA may be a line data signal.

In this case, the N bit image data SDATA may include an N−M bit image code (or an upper bit signal) and an M bit interpolation code (or a lower bit signal). The N−M bit image code may denote bits for outputting a real image, and the M bit interpolation code may denote bits for a voltage interpolation. Hereinafter, for convenience of description, the terms "N−M bit image code" and "upper bit signal" may be used as the same meaning, and the terms "M bit interpolation code" and "lower bit signal" may be used as the same meaning.

Figure 2:
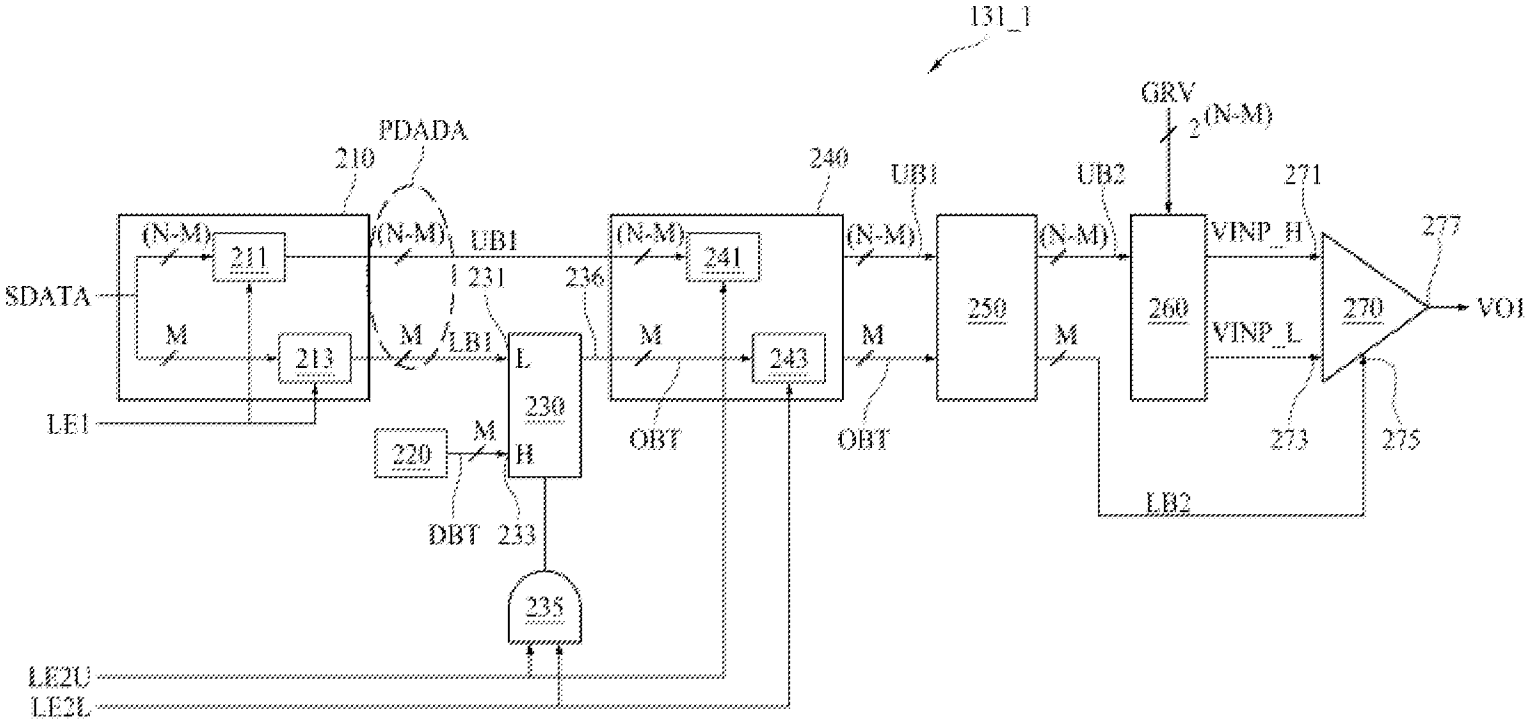
FIG. 2 is a block diagram of a source drive IC illustrated in FIG. 1.

The gamma reference voltage generator 120 may generate a plurality of gamma reference voltages GRV by using the first control signal CTRL1, and the plurality of gamma reference voltages GRV may be supplied to the source driving circuit 130 through a plurality of voltage lines. The number of gamma reference voltages GRV, as illustrated in FIG. 2, may be a $2^{(N-M)}$ number.

The source driving circuit 130 may be referred to as a column driver circuit or a data line driver circuit and may supply data voltages VO1 to VOy to y number of data lines DL1 to DLy included in the display panel 150 by using the N bit image data SDATA and the second control signal CTRL2. The N bit image data SDATA may be an N bit serial signal.

The source driving circuit 130 may include y number of source drive ICs 131_1 to **131_*y* for supplying the data voltages VO1 to VOy to the y data lines DL1 to DLy. In an embodiment, each of the y source drive ICs 131_1 to 131_*y* may be configured as an IC chip, or the y source drive ICs 131_1 to 131_*y*** may be configured as one IC chip.

Each of the y source drive ICs 131_1 to **131_*y* may be referred to as a driving device or a driving circuit and may perform a voltage interpolation twice at every horizontal period corresponding to a difference between horizontal synchronization signals. That is, each of the y source drive ICs 131_1 to 131_*y*** may sequentially perform a first voltage interpolation and the second voltage interpolation at every one horizontal period.

The gate driving circuit 140 may be referred to as a row driver circuit and may sequentially generate x number of gate signals G1 to Gx (or gate pulses) for driving x number of gate lines GL1 to GLx in response to the third control signal CTRL3. Here, x and y may each be a natural number of 2 or more.

The display panel 150 may include a plurality of pixels PX, and each of the pixels PX may be connected to a corresponding gate line of the x gate lines GL1 to GLx and a corresponding data line of the y data lines DL1 to DLy. For example, the display panel 150 may be manufactured by using low-temperature polycrystalline oxide (LTPO) process technology and may be an organic light emitting diode (OLED) display apparatus.

FIG. 2 is a block diagram of a source drive IC illustrated in FIG. 1. Referring to FIG. 2, structures of the y source drive ICs 131_1 to **131_*y* may be the same, and thus, a structure and an operation of a first source drive IC 131_1** will be described below.

Referring to FIG. 2, the first source drive IC 131_1 may include a first latch circuit 210, a reference code storage circuit 220, a switch circuit 230, an AND gate 235, a second latch circuit 240, a voltage level shifter 250, a digital-to-analog converter (DAC) 260, and an amplifier circuit 270 for performing a voltage interpolation.

The first latch circuit 210 may receive the N bit image data SDATA transferred from the timing controller 110 and may sequentially store the N bit image data SDATA by bit units. That is, the first latch circuit 210 may perform a function of converting the N bit serial image data SDATA into N bit parallel image data PDATA.

The first latch circuit 210 may include a first sub latch circuit 211 and a second sub latch circuit 213. The first sub latch circuit 211 may latch first upper bit signals UB1 of the N bit parallel image data PDATA in response to a first latch enable signal LE1 activated to a high level. The second sub latch circuit 213 may latch first lower bit signals LB1 of the N bit parallel image data PDATA in response to the first latch enable signal LE1 activated to a high level. Here, a bit signal may be referred to as a bit and may denote a signal having logic 1 or logic 0.

The first upper bit signals UB1 may include a most significant bit (MSB) and may be N−M bit signals. The first lower bit signals LB1 may include a least significant bit (LSB) and may be M bit signals. For example, N may be 11 and M may be 3, but the present invention is not limited thereto.

The reference code storage circuit 220 may store a reference code DBT. The reference code DBT may be referred to as dummy bit signals or a common interpolation code which is set in common for each channel. The reference code DBT may be programmed from the outside. In an embodiment, the reference code storage circuit 220 may be a non-volatile memory device.

For example, the reference code storage circuit 220 of each of the y source drive ICs 131_1 to **131_*y*** may store the same reference code DBT. The reference code DBT may be M bit signals.

In an embodiment, the reference code DBT may be set to a value which enables implementation of a fastest interpolation.

The switch circuit 230 may output, to a fourth sub latch circuit 243 of the second latch circuit 240 through an output terminal 236, an output signal (i.e., first lower bit signals LB1) of the second sub latch circuit 213 input through a first input terminal 231 or the reference code DBT input through a second input terminal 233.

The AND gate 235 may perform an AND operation on an upper bit latch enable signal LE2U (or a second latch enable signal) and a lower bit latch enable signal LE2L (or a third latch enable signal) and may output an AND operation result to the switch circuit 230.

Figure 3:
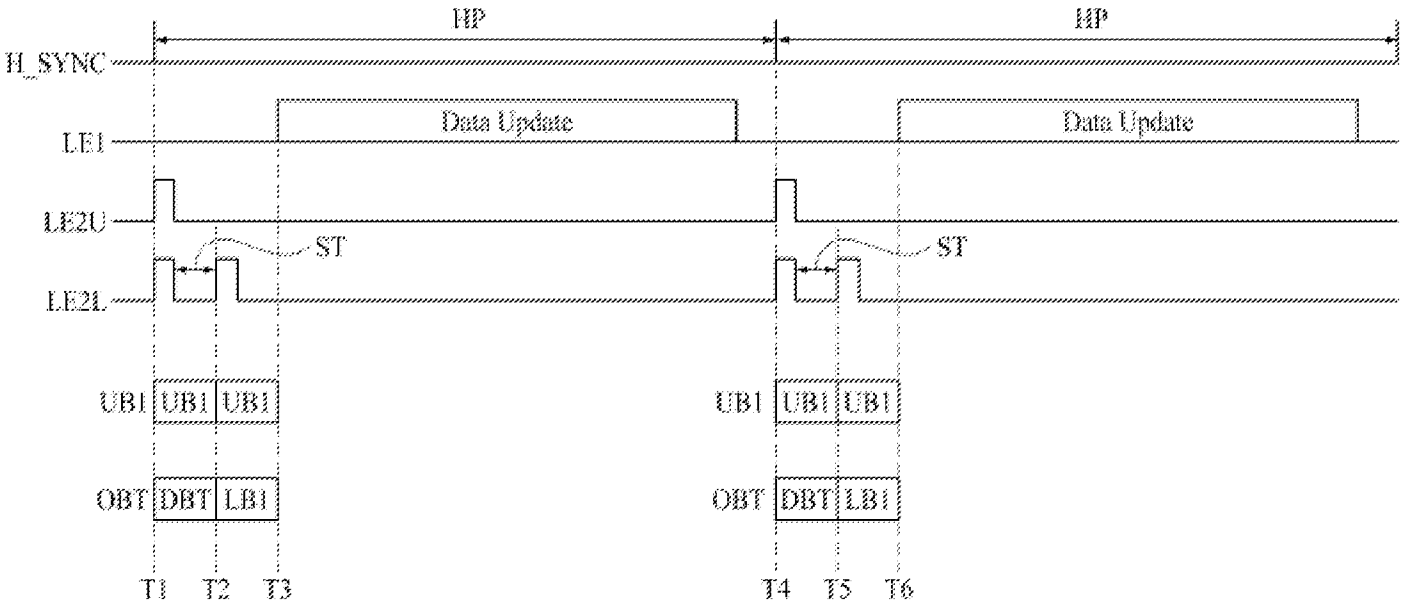
FIG. 3 is an operation timing diagram of the source drive IC illustrated in FIG. 2.

As illustrated in FIG. 3, when a level of the upper bit latch enable signal LE2U is logic high and a level of the lower bit latch enable signal LE2L is logic low, namely, when an output signal of the AND gate 235 is activated to a high level, the switch circuit 230 may output the reference code DBT, input through the second input terminal 233, to the fourth sub latch circuit 243 of the second latch circuit 240 through the output terminal 236.

However, as illustrated in FIG. 3, when a level of the upper bit latch enable signal LE2U is logic low and a level of the lower bit latch enable signal LE2L is logic high, namely, when an output signal of the AND gate 235 is deactivated to a low level, the switch circuit 230 may output the first lower bit signals LB1, input through the first input terminal 231, to the fourth sub latch circuit 243 of the second latch circuit 240 through the output terminal 236.

The second latch circuit 240 may include a third sub latch circuit 241 and a fourth sub latch circuit 243. The third sub latch circuit 241 may latch the first upper bit signals UB1 output from the first sub latch circuit 211 by using the activated upper bit latch enable signal LE2U. The fourth sub latch circuit 243 may latch bit signals OBT (where OBT is DBT or LB1) output from the switch circuit 230 by using the activated lower bit latch enable signal LE2L.

Each of the latch circuits 210, 211, 213, 240, 241, and 243 described herein may be replaced with a flip-flop or a register as an example of a data storage device.

The voltage level shifter 250 may shift a voltage level of each of the first upper bit signals UB1 output from the third sub latch circuit 241. The voltage level shifter 250 may generate the second upper bit signals UB2 corresponding to a voltage level shift result and may output only the second upper bit signals UB2 to the DAC 260.

Moreover, the voltage level shifter 250 may shift a voltage level of each of the bit signals OBT output from the fourth sub latch circuit 243. The voltage level shifter 250 may generate the second lower bit signals LB2 corresponding to a voltage level shift result and may output only the second lower bit signals LB2 to a control terminal 275 of the amplifier circuit 270. A terminal may be referred to as a pin, a pad, or a port.

The DAC 260 may receive the second upper bit signals UB2 and may select a first gamma reference voltage VINP_H and a second gamma reference voltage VINP_L from among a plurality of gamma reference voltages GRV by using the second upper bit signals UB2. The DAC 260 may output the selected first gamma reference voltage VINP_H to a first input terminal 271 of the amplifier circuit 270 and may output the selected second gamma reference voltage VINP_L to a second input terminal 273 of the amplifier circuit 270.

The amplifier circuit 270 may sequentially perform first and second voltage interpolations by using the selected voltages VINP_H and VINP_L and the second lower bit signals LB2 at every horizontal period HP illustrated in FIG. 3. The amplifier circuit 270 may output a data voltage VO1 corresponding to a result of each of the first and second voltage interpolations to a first data line DL1 through an output terminal 277.

FIG. 3 is an operation timing diagram of the source drive IC illustrated in FIG. 2. Referring to FIGS. 1 to 3, each of the source drive ICs 131_1 to **131_*y*** may sequentially perform the first and second voltage interpolations at every horizontal period HP defined by two horizontal synchronization signals H_SYNC corresponding thereto.

Referring to FIGS. 2 and 3, when the upper bit latch enable signal LE2U is activated to a high level and the lower bit latch enable signal LE2L is activated to a high level at a first time T1, the AND gate 235 may generate an output signal having a high level. Accordingly, the switch circuit 230 may output the reference code DBT, input to the second input terminal 233, as the output bit signals OBT through the output terminal 236.

That is, during the first voltage interpolation, the first sub latch circuit 211 may output the first upper bit signals UB1, and the switch circuit 230 may output the reference code DBT (OBT=DBT). Accordingly, the second lower bit signals LB2 corresponding to the reference code DBT may be transferred to the control terminal 275 of the amplifier circuit 270.

Even when the image data SDATA input is changed, the reference code DBT may not be changed.

At a second time T2, the upper bit latch enable signal LE2U may have a low level, and the lower bit latch enable signal LE2L may be activated to a high level. Therefore, the AND gate 235 may generate an output signal having a low level. Accordingly, the switch circuit 230 may output the first lower bit signals LB1, input to the first input terminal 231, as the output bit signals OBT (OBT=LB1) through the output terminal 236.

That is, during the second voltage interpolation, the first sub latch circuit 211 may output the first upper bit signals UB1, and the switch circuit 230 may output the first lower bit signals LB1. Accordingly, the second lower bit signals LB2 corresponding to the first lower bit signals LB1 may be transferred to the control terminal 275 of the amplifier circuit 270.

The first latch enable signal LE1 may be activated to a high level at a third time T3, and thus, the first latch circuit 210 may latch the N bit parallel image data PDATA in response to the activated first latch enable signal LE1. Accordingly, the N bit parallel image data latched by the first latch circuit 210 may be updated to new N bit parallel image data.

In FIG. 3, a settling period or a settling time may be defined as 'ST'.

An operation of the switch circuit 230 at each of times T4 to T6 may be the same as an operation of the switch circuit 230 at each of times T1 to T3, and thus, a description thereof is omitted.

Figure 4:
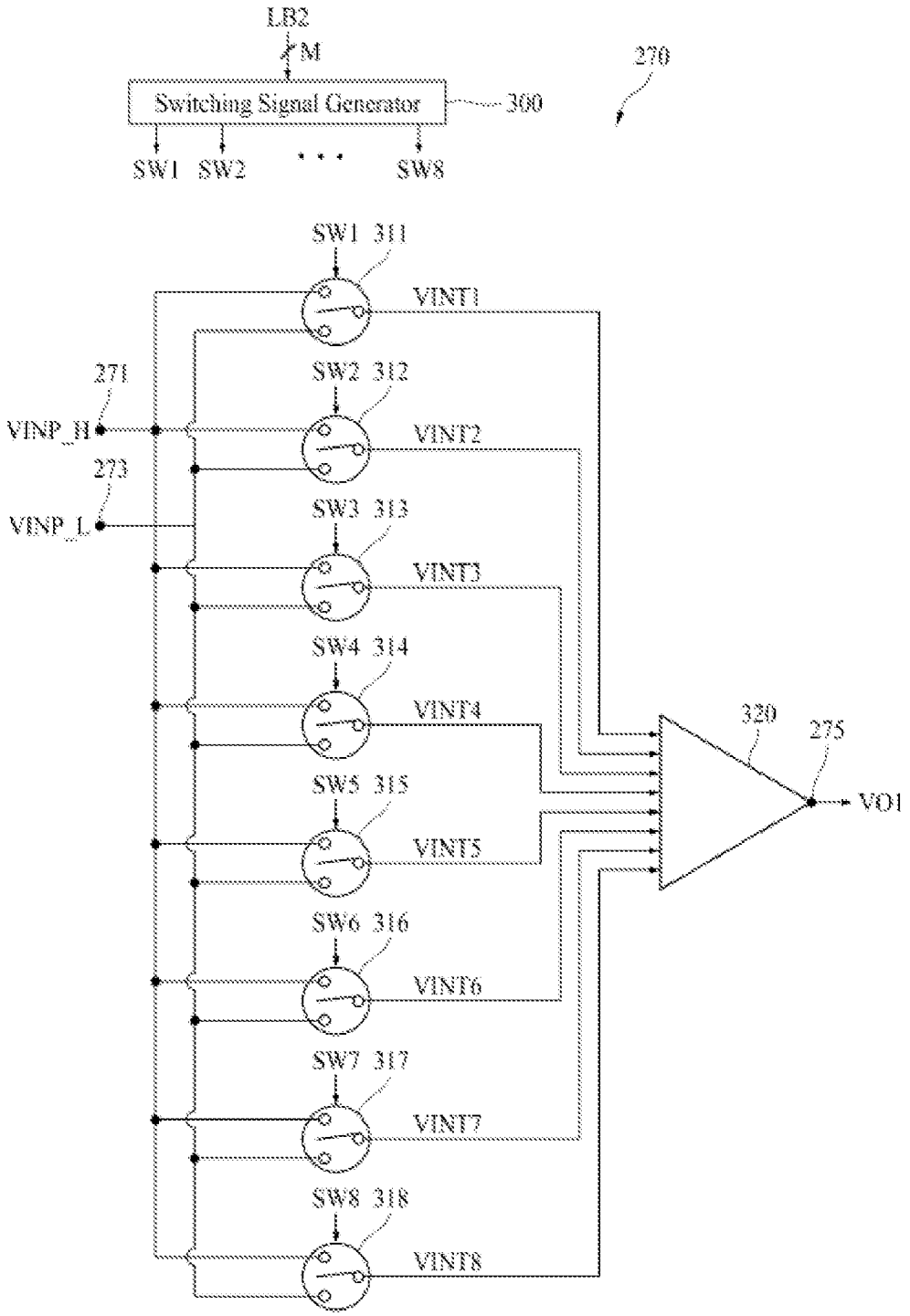
FIG. 4 is a circuit diagram of an amplifier circuit illustrated in FIG. 2.

FIG. 4 is a circuit diagram of the amplifier circuit illustrated in FIG. 2.

Referring to FIG. 4, the amplifier circuit 270 may include a switching signal generator 300, a plurality of switches 311 to 318, and an amplifier 320.

During the first voltage interpolation, the switching signal generator 300 may generate a plurality of switching signals SW1 to SW8 in response to the second lower bit signals LB2 corresponding to the reference code DBT.

For example, the switching signal generator 300 may decode the reference code DBT and may generate the plurality of switching signals SW1 to SW8 corresponding to a decoding result. When the reference code DBT is 3 bit signals and the second lower bit signals LB2 are 3 bit signals, the number of switching signals SW1 to SW8 may be $2^3$ (=8).

A first input terminal of each of the plurality of switches 311 to 318 may be connected to a first input terminal 271 which receives the first gamma reference voltage VINP_H. A second input terminal of each of the switches 311 to 318 may be connected to a second input terminal 273 which receives the second gamma reference voltage VINP_L. An output terminal of each of the switches 311 to 318 may be connected to each input terminal of amplifier 320.

Each of the switches 311 to 318 may output, to the amplifier 320, one of the first gamma reference voltage VINP_H applied to the first input terminal 271 and the second gamma reference voltage VINP_L applied to the second input terminal 273 as output signals VINT1 to VINT8 in response to a corresponding switching signal of the switching signals SW1 to SW8.

FIG. 5 is a table showing an output signal and input signals of the amplifier circuit illustrated in FIG. 4.

Referring to FIGS. 4 and 5, when the second lower bit signals LB2 are binary numbers '000', the switching signal generator 300 may generate the switching signals SW1 to SW8 each having a low level, and thus, each of the switches 311 to 318 may output the second gamma reference voltage VINP_L as a corresponding output signal of the output signals VINT1 to VINT8 in response to a corresponding switching signal of the switching signals SW1 to SW8 having a low level. The amplifier 320 may calculate an average value of levels of eight output signals VINT1 to VINT8.

Therefore, the amplifier 320 may receive the eight output signals VINT1 to VINT8 and may perform an interpolation on the received output signals VINT1 to VINT8 as expressed in the following Equation 1 to generate a data voltage VO1, and thus, may output the generated data voltage VO1 to a first data line DL1.

$$VO1 = \frac{0 * \text{VINP_H}}{8} + \frac{8 * \text{VINP_L}}{8} \quad \text{[Equation 1]}$$

As another example, when the second lower bit signals LB2 are binary numbers '001', the switching signal generator 300 may generate the switching signal SW1 having a high level and the switching signals SW2 to SW8 having a low level. Therefore, the switch 311 may output the first gamma reference voltage VINP_H as the output signal VINT1 in response to the switching signal SW1 having a high level, and each of the switches 312 to 318 may output the second gamma reference voltage VINP_L as a corresponding output signal of the output signals VINT2 to VINT8 in response to a corresponding switching signal of the switching signals SW2 to SW8 having a low level.

Therefore, the amplifier 320 may receive the eight output signals VINT1 to VINT8 and may perform an interpolation on the received output signals VINT1 to VINT8 as expressed in the following Equation 2 to generate the data voltage VO1, and thus, may output the generated data voltage VO1 to the first data line DL1.

$$VO1 = \frac{1 * \text{VINP_H}}{8} + \frac{7 * \text{VINP_L}}{8} \quad \text{[Equation 2]}$$

As another example, when the second lower bit signals LB2 are binary numbers '100', the switching signal generator 300 may generate the switching signals SW1 to SW4 having a high level and the switching signals SW5 to SW8 having a low level. Therefore, each of the switches 311 to 314 may output the first gamma reference voltage VINP_H as a corresponding output signal of the output signals VINT1 to VINT4 in response to the switching signals SW1 to SW4 having a high level, and each of the switches 315 to 318 may output the second gamma reference voltage VINP_L as a corresponding output signal of the output signals VINT5 to VINT8 in response to a corresponding switching signal of the switching signals SW5 to SW8 having a low level.

Therefore, the amplifier 320 may receive the eight output signals VINT1 to VINT8 and may perform an interpolation on the received output signals VINT1 to VINT8 as expressed in the following Equation 3 to generate the data voltage VO1, and thus, may output the generated data voltage VO1 to the first data line DL1.

$$VO1 = \frac{4 * \text{VINP_H}}{8} + \frac{4 * \text{VINP_L}}{8} \quad \text{[Equation 3]}$$

As another example, when the second lower bit signals LB2 are binary numbers '111', the switching signal generator 300 may generate the switching signals SW1 to SW7 having a high level and the switching signal SW8 having a low level. Therefore, each of the switches 311 to 317 may output the first gamma reference voltage VINP_H as a corresponding output signal of the output signals VINT1 to VINT7 in response to the switching signals SW1 to SW7 having a high level, and the switch 318 may output the second gamma reference voltage VINP_L as the output signal VINT8 in response to the switching signal SW8 having a low level.

Therefore, the amplifier 320 may receive the eight output signals VINT1 to VINT8 and may perform an interpolation on the received output signals VINT1 to VINT8 as expressed in the following Equation 4 to generate the data voltage VO1, and thus, may output the generated data voltage VO1 to the first data line DL1.

$$VO1 = \frac{7 * \text{VINP_H}}{8} + \frac{1 * \text{VINP_L}}{8} \quad \text{[Equation 4]}$$

Figure 6:
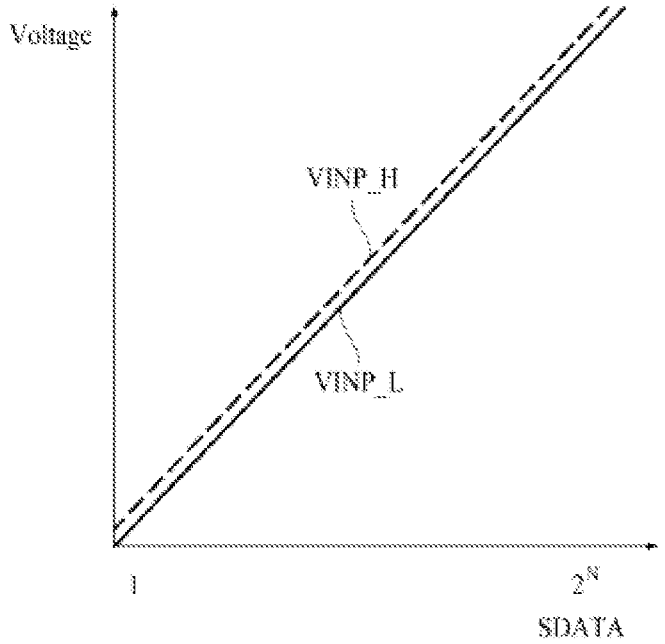
FIG. 6 is a graph of input signal of the amplifier circuit of FIG. 4 with respect to input data.

FIG. 6 is a graph of input signal of the amplifier circuit of FIG. 4 with respect to input data. Referring to FIG. 6, it may be seen that a level of the first gamma reference voltage VINP_H and a level of the second gamma reference voltage VINP_L increase as the number of bits included in the N bit serial image data SDATA input to the first latch circuit 210 increases.

Figure 7:
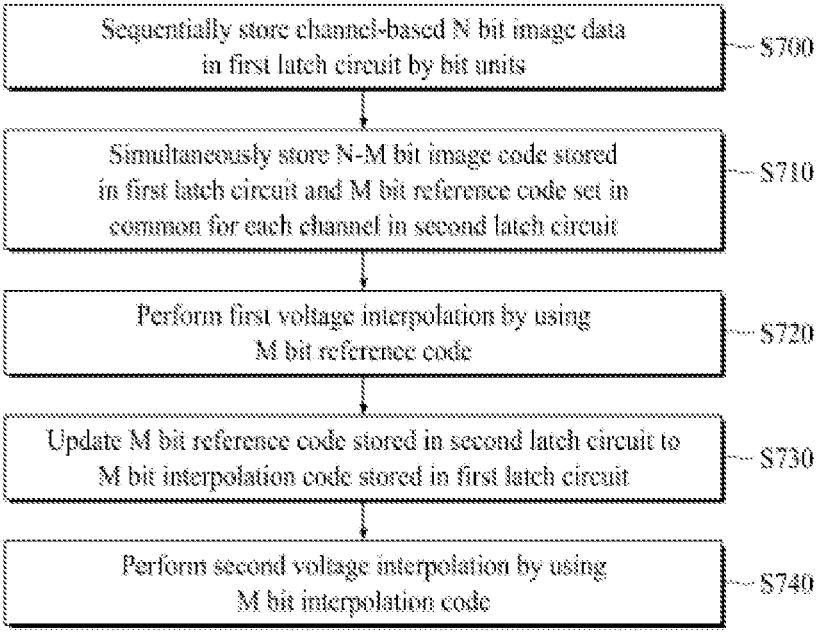
FIG. 7 is a flowchart illustrating a driving method of a display apparatus according to an embodiment of the present invention.

Hereinafter, a driving method of a display apparatus according to the present invention will be described with reference to FIG. 7. FIG. 7 is a flowchart illustrating a driving method of a display apparatus according to an embodiment of the present invention. The driving method of the display apparatus may be performed by the source drive IC illustrated in FIG. 1.

First, the source drive IC may sequentially store channel-based (or data line-based) N bit image data, received from a timing controller, in a first latch circuit by bit units (S700). The N bit image data may include an N–M bit image code (or an upper bit signal) and an M bit interpolation code (or a lower bit signal).

In an embodiment, the N–M bit image code may include an MSB of image data, and the M bit interpolation code may include an LSB of the image data.

Subsequently, the source drive IC may simultaneously store the N–M bit image code stored in the first latch circuit and an M bit reference code, which is set in common for each channel, in a second latch circuit (S710). The M bit reference code may be stored in a reference code storage circuit. The M bit reference code may be referred to as a common interpolation code set in common for each channel or dummy bit signals and may be programmed from the outside.

Subsequently, the source drive IC may perform a first voltage interpolation by using the M bit reference code (S720).

In detail, the source drive IC may select a first gamma reference voltage and a second gamma reference voltage from among a plurality of gamma reference voltages based on the N–M bit image code, and then, may select one gamma reference voltage from among the first gamma reference voltage and the second gamma reference voltage based on the M bit reference code to generate $2^M$ number of output signals. Subsequently, the source drive IC may perform the first voltage interpolation based on the $2^M$ output signals to output a first data voltage corresponding to image data. In an embodiment, the source drive IC may average the $2^M$ output signals to calculate the first data voltage.

Subsequently, the source drive IC may update the M bit reference code, stored in the second latch circuit, to the M bit interpolation code stored in the first latch circuit (S730).

Subsequently, the source drive IC may perform a second voltage interpolation by using the M bit interpolation code (S740). In detail, the source drive IC may select the first gamma reference voltage and the second gamma reference voltage from among the plurality of gamma reference voltages based on the N–M bit image code, and then, may select one gamma reference voltage from among the first gamma reference voltage and the second gamma reference voltage based on the M bit interpolation code to generate $2^M$ number of output signals. Subsequently, the source drive IC may perform the second voltage interpolation based on the $2^M$ output signals to output a second data voltage corresponding to the image data. In an embodiment, the source drive IC may average the $2^M$ output signals to calculate the second data voltage.

As described above, according to the present invention, the first voltage interpolation may be performed on image data of each channel by using a reference code, which is set in common for each channel, at a change time of image data, and then, the second voltage interpolation may be performed on corresponding image data by using an interpolation code included in corresponding image data, thereby preventing the occurrence of different settling times caused by different interpolation codes for each channel.

Moreover, in a case where a display panel is an LTPO type display panel having a characteristic sensitive to a time like a 120 Hz operation, when the source drive IC according to the present invention is applied, the display panel may have a stable characteristic.

Particularly, when a reference code is set to a value which enables implementation of a fastest interpolation, a settling time may be more improved.

According to the present invention, a settling time may be prevented from being changed when image data input to a source drive IC is changed for the voltage interpolation.

Moreover, according to the present invention, a voltage interpolation may be performed twice at every horizontal period, and a first voltage interpolation of the voltage interpolation may be performed by using a common reference code for each channel, thereby always obtaining the same response time.

Moreover, according to the present invention, even when a display panel is an LTPO type display panel having a sensitive characteristic at a time as in 120 Hz operation, the display panel may have a stable characteristic by using a source drive IC according to the present invention.

Moreover, according to the present invention, a reference code may be set to have a value which enables implementation of a fastest interpolation, and thus, a settling time may be more enhanced.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It may be understood that those skilled in the art may modify the present invention in other detailed forms without changing the technical spirit or the essential feature.

All disclosed methods and procedures described herein may be implemented, at least in part, using one or more computer programs or components. These components may be provided as a series of computer instructions through any conventional computer-readable medium or machine-readable medium including volatile and nonvolatile memories such as random-access memories (RAMs), read only-memories (ROMs), flash memories, magnetic or optical disks, optical memories, or other storage media. The instructions may be provided as software or firmware, and may, in whole or in part, be implemented in a hardware configuration such as application-specific integrated circuits (ASICs), field-programmable gate arrays (FPGAs), digital signal processors (DSPs), or any other similar device. The instructions may be configured to be executed by one or more processors or other hardware configurations, and the processors or other hardware configurations are allowed to perform all or part of the methods and procedures disclosed herein when executing the series of computer instructions.

Therefore, the above-described embodiments should be understood to be exemplary and not limiting in every aspect. The scope of the present disclosure will be defined by the following claims rather than the above-detailed description, and all changes and modifications derived from the meaning and the scope of the claims and equivalents thereof should be understood as being included in the scope of the present disclosure.

What is claimed is:

1. A display apparatus comprising:

a source drive integrated circuit (IC) configured to sequentially perform a first voltage interpolation and a second voltage interpolation at every horizontal period so as to drive a data line by using N bit image data including an M bit interpolation code and an N−M bit image code, wherein the source drive IC performs the first voltage interpolation by using an M bit reference code set in common for each channel and performs the second voltage interpolation by using the M bit interpolation code.

2. The display apparatus of claim 1, wherein the source drive IC comprises:

a plurality of switches configured to receive a first gamma reference voltage and a second gamma reference voltage and output one of the first gamma reference voltage and the second gamma reference voltage in response to a switching signal generated by decoding the M bit reference code or the M bit interpolation code; and an amplifier configured to receive output signals of the plurality of switches and perform the first voltage interpolation or the second voltage interpolation based on the received output signals to output a data voltage corresponding to the image data.

3. The display apparatus of claim 2, wherein the amplifier outputs the data voltage corresponding to an average value of the output signals.

4. The display apparatus of claim 2, wherein the source drive IC comprises:

a digital-to-analog converter configured to output the first gamma reference voltage and the second gamma reference voltage of the plurality of gamma reference voltages, based on the N−M bit image code; and a switching signal generator configured to decode the M bit reference code or the M bit interpolation code to generate the switching signal for each switch.

5. The display apparatus of claim 4, wherein the source drive IC further comprises:

a first latch circuit configured to sequentially store the N bit image data by bit units in response to a first latch enable signal;

a second latch circuit configured to simultaneously store the N−M bit image code stored in the first latch circuit and the M bit reference code and update the M bit reference code to the M bit interpolation code stored in the first latch circuit; and a voltage level shifter configured to shift a voltage level of the N−M bit image code output from the second latch circuit to output a level-shifted N−M bit image code to the digital-to-analog converter and shift a voltage level of the M bit interpolation code or the M bit reference code output from the second latch circuit to output a level-shifted M bit interpolation code or M bit reference code to the amplifier.

6. The display apparatus of claim 5, wherein the source drive IC further comprises a switch circuit configured to selectively output the M bit interpolation code stored in the first latch circuit or the M bit reference code in response to a combination of a second latch enable signal and a third latch enable signal, wherein the second latch circuit stores the N−M bit image code stored in the first latch circuit in response to the second latch enable signal and stores a signal output from the switch circuit in response to the third latch enable signal.

7. The display apparatus of claim 6, wherein the switch circuit outputs the M bit reference code to the second latch circuit, and then, outputs the M bit interpolation code to the second latch circuit.

8. The display apparatus of claim 6, wherein the source drive IC further comprises an AND gate configured to receive the second latch enable signal and the third latch enable signal, wherein, when an output signal of the AND gate is activated, the switch circuit outputs the M bit reference code to the second latch circuit, and when the output signal of the AND gate is deactivated, the switch circuit outputs the M bit interpolation code to the second latch circuit.

9. The display apparatus of claim 1, wherein the source drive IC comprises a reference code storage circuit configured to store the M bit reference code.

10. The display apparatus of claim 1, wherein the N−M bit image code comprises a most significant bit (MSB) of the image data, and the M bit interpolation code comprises a least significant bit (LSB) of the image data.

11. The display apparatus of claim 1, further comprising a display panel manufactured by using low-temperature polycrystalline oxide (LTPO) process technology.

12. The display apparatus of claim 1, wherein the horizontal period is a period between two horizontal synchronization signals.

13. The display apparatus of claim 1, further comprising a timing controller configured to generate the N bit image data for each channel and transfer the generated N bit image data to a source drive IC corresponding to each channel.

14. A driving method of a display apparatus, the driving method comprising:

sequentially storing N bit image data of each channel in a first latch circuit by bit units, the N bit image data including an N−M bit image code and an M bit interpolation code;

simultaneously storing the N−M bit image code stored in the first latch circuit and an M bit reference code in a second latch circuit, the M bit reference code being set in common for each channel;

performing a first voltage interpolation by using the M bit reference code;

updating the M bit reference code stored in the second latch circuit to the M bit interpolation code stored in the first latch circuit; and performing a second voltage interpolation by using the M bit interpolation code.

15. The driving method of claim 14, wherein the performing the first voltage interpolation comprises:

selecting a first gamma reference voltage and a second gamma reference voltage among a plurality of gamma reference voltages based on the N−M bit image code;

selecting one gamma reference voltage between the first gamma reference voltage and the second gamma reference voltage based on the M bit reference code to generate $2^M$ number of output signals; and performing the first voltage interpolation based on the $2^M$ output signals to output a first data voltage corresponding to the image data.

16. The driving method of claim 15, wherein the first data voltage is calculated by averaging the $2^M$ output signals.

17. The driving method of claim 14, wherein the performing the second voltage interpolation comprises:

selecting a first gamma reference voltage and a second gamma reference voltage among a plurality of gamma reference voltages based on the N−M bit image code;

selecting one gamma reference voltage between the first gamma reference voltage and the second gamma reference voltage based on the M bit interpolation code to generate $2^M$ number of output signals; and performing the second voltage interpolation based on the $2^M$ output signals to output a second data voltage corresponding to the image data.

18. The driving method of claim 17, wherein the second data voltage is calculated by averaging the $2^M$ output signals.

19. The driving method of claim 14, wherein the N−M bit image code comprises a most significant bit (MSB) of the image data, and the M bit interpolation code comprises a least significant bit (LSB) of the image data.

20. The driving method of claim 14, wherein the first voltage interpolation and the second voltage interpolation are sequentially performed at every horizontal period, and wherein the horizontal period is a period between two horizontal synchronization signals.

* * * * *